United States Patent [19]

Leifeld

[11] 4,344,843

[45] Aug. 17, 1982

[54] APPARATUS AND METHOD FOR SEPARATING DEBRIS FROM TEXTILE FIBER TUFTS

[75] Inventor: Ferdinand Leifeld, Kempen, Fed. Rep. of Germany

[73] Assignee: Trutzscher GmbH & Co. KG, Monchen-Gladbach, Fed. Rep. of Germany

[21] Appl. No.: 235,997

[22] Filed: Feb. 19, 1981

[30] Foreign Application Priority Data

Feb. 23, 1980 [DE] Fed. Rep. of Germany ..... 3006831

[51] Int. Cl.[3] ..... B07B 7/02; B07B 7/06

[52] U.S. Cl. ..... 209/143; 209/250; 406/156

[58] Field of Search ..... 209/20–23, 209/143, 250, 144, 133, 139, 136, 137; 19/205; 406/156

[56] References Cited

U.S. PATENT DOCUMENTS

| | | | |
|---|---|---|---|
| 2,580,581 | 1/1952 | Niemitz | 406/156 |
| 2,810,163 | 10/1957 | Kyame et al. | 19/205 X |
| 3,096,276 | 7/1963 | Franks et al. | 209/143 X |
| 3,265,210 | 8/1966 | Harte et al. | 209/143 X |
| 3,435,484 | 4/1969 | Langdon | 406/156 X |
| 3,555,794 | 1/1971 | Gable et al. | 209/136 X |

FOREIGN PATENT DOCUMENTS

| | | | |
|---|---|---|---|
| 1115131 | 5/1968 | United Kingdom | 406/156 |
| 664689 | 5/1979 | U.S.S.R. | 209/250 |

*Primary Examiner*—Ralph J. Hill

*Attorney, Agent, or Firm*—Bell, Seltzer, Park & Gibson

[57] ABSTRACT

Debris is separated from pneumatically conveyed textile fiber tufts moving through a conduit by diverting a flow of air and debris from the conduit and returning the flow of air to the conduit so as to restore the volume of air flowing through the conduit.

13 Claims, 5 Drawing Figures

APPARATUS AND METHOD FOR SEPARATING DEBRIS FROM TEXTILE FIBER TUFTS

FIELD AND BACKGROUND OF INVENTION

Certain textile processes pneumatically convey tufts of textile fiber from point to point as the fiber moves through certain processes. For example, textile fiber received in compacted bales may be plucked from the bales, opened, and delivered to cards for formation into fiber bats all while being moved through the use of flowing streams of air. Such processes of using flowing streams of air to move tufts of textile fiber are referred to as pneumatically conveying textile fiber tufts.

Certain textile fibers received at a textile mill in compacted bales, and particularly cotton, contain impurities or debris which may take the form of stalks, husk residues, portions of leaves or the like. Persons familiar with the handling and processing of textile fiber as briefly described above, and particularly the plucking, opening and feeding of cotton fiber tufts, will be familiar with the presence of such debris and the difficulties which are introduced thereby into the manufacturing processes and the finished textile products.

It has been proposed heretofore that debris and the like may be removed from pneumatically conveyed textile fiber tufts. One such proposal has involved diverting a flowing stream of air and tufts conveyed thereby such as by directing the flow along a curving path. Due to the anticipated effect of centrifugal forces and the curvature of the path, it is anticipated that debris, being heavier than the textile fiber tufts, will be directed to the outer area of a curving portion of a path in a conduit or the like. The debris may then be removed from the path in some appropriate manner. In at least one known prior arrangement, a screen or grid may be installed in a conveying conduit in such a manner that a portion of the flowing air stream, possibly containing debris, is diverted and directed into an exit conduit, duct or tube. In such arrangements as known heretofore, the air and debris have simply been vented, giving rise to the double deficiencies of environmental polution and loss in air flow due to dissipation of a portion of the conveying stream.

BRIEF DESCRIPTION OF INVENTION

Keeping in mind the aforementioned difficulties and deficiencies in the pneumatic conveying of textile fiber tufts while debris is removed therefrom, it is an object of this invention to provide an apparatus of the type generally described in which debris is removed from a separated, partial air stream, and in which the volume of air flowing to convey tufts is maintained. In realizing this object of the present invention, a housing defining a debris trapping zone and a debris separation chamber operatively communicates at two points with a conduit through which pneumatically conveyed textile fiber tufts are moving. By such a two-point communication, a flow of air and debris is deflected from the conduit for trapping debris while the flow is returned to the conduit so as to maintain the volume of air flowing therethrough.

Yet a further object of the present invention is, in a method of pneumatically conveying cotton fiber tufts, collecting debris from the tufts while maintaining high efficiency in pneumatic conveyance. In realizing this object of the present invention, a portion of a conveying air flow is diverted to pass through a debris separation and collection chamber. Division of the flow is accomplished in such a manner as to carry into the chamber debris to be separated from the cotton tufts. Following separation of the debris and flowing air, the air is returned to the main conveying conduit.

In accordance with yet another object of the present invention, debris and a partial air stream conveying that debris leave a main pneumatic conveyance conduit through a slatted grid formed in a curve of the main conduit and pass into a chamber enclosing a portion of the conduit. Within the chamber, the velocity of the partial air flow drops, facilitating separation of debris from air. The air flow then continues from the chamber, returning to the main stream conduit downstream of the slatted exit or withdrawal opening.

BRIEF DESCRIPTION OF DRAWINGS

Some of the objects of the invention having been stated, other objects will appear as the description proceeds, when taken in connection with the accompanying drawings, in which.

DETAILED DESCRIPTION OF INVENTION

While the present invention will be described hereinafter with particular reference to the accompanying drawings, it is to be understood at the outset of the description which follows that it is contemplated that the invention may be changed in various ways while still achieving the beneficial result described. For that reason, the description which follows is to be understood as a broad, teaching disclosure directed to enabling persons of ordinary skill in the applicable arts to fully use the present invention, and not as limiting upon the scope of this invention.

Figure 1:
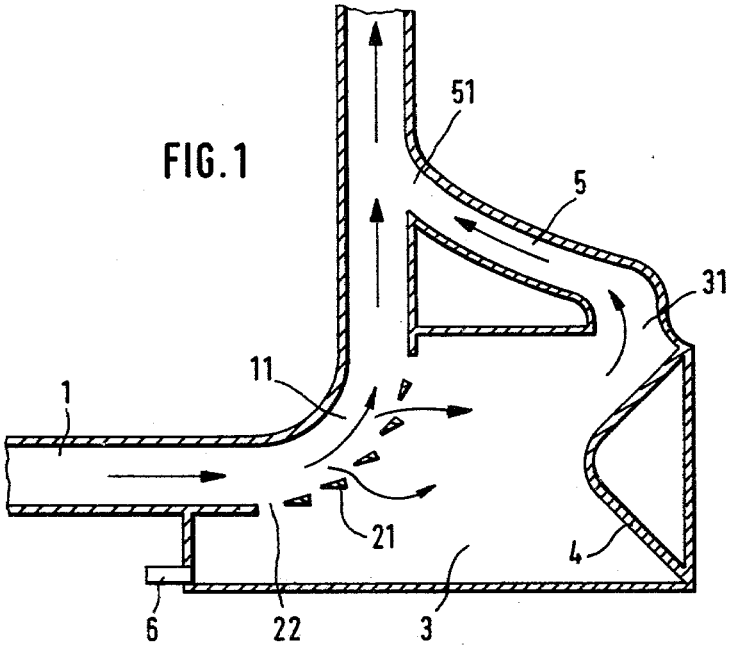
FIG. 1 is a schematic side view, in section, of an apparatus according to this invention.

Referring now more particularly to FIG. 1, a conduit is there shown, and generally indicated at 1, through which textile fiber tufts are pneumatically conveyed in a known manner. To any extent necessary to an understanding of this invention, the interested reader is referred to other prior patents and publications describing such pneumatic conveyance of textile fiber tufts. The conduit 1 has a curving deflection area generally indicated at 11 and which is similar to an elbow, turning through approximately 90°. A housing means is provided for cooperating with the conduit in defining a debris trapping zone and a debris separation chamber, as described more fully hereinafter. In the form illustrated, the housing means extends immediately adjacent the conduit 1 and, in the region of the deflection area 11, may include portions of the conduit 1 itself.

Means are provided for cooperating with the conduit in establishing operative communication of the debris trapping zone with the conduit 1 for diverting a flow of air and debris from the conduit and thereby for trapping debris. In the form shown, such means includes a plurality of parallel and successively arranged separating blades 21, preferably in the form of slats or bars. The blades are arranged in an array and spaced one from another so as to define openings 22. The open areas 22 together define the debris trapping zone, while the slats or bars 21 function as a means for diverting a debris laden portion of the stream of air from the conduit 1 while the majority of the flowing stream is continued to be directed through the conduit.

Within the housing which defines the debris separation chamber is provided a deflecting element 4, arranged oppositely the trapping zone and rounded off at approximately the height of the trapping zone. The separation chamber, generally indicated at 3, is defined between the trapping zone and the deflecting element. An outlet duct 31 connects the separation chamber 3 with an exit duct 5 which enters into the conduit 1 at an entry point 51. At the entry point 51, the convergence of the exhaust duct 5 with the conduit 1 is preferably constructed as an injector nozzle. Where the convergence is constructed as a nozzle, it aids the induction of an air flow. Thus, the exit duct 5 connects the debris separation chamber 3 with the conduit 1 and terminates in the conduit 1 downstream of the debris trapping zone defined by the open areas 22.

In operation, suitable apparatus (not shown), such as a bale opener and associated mechanism, induces a flow, through the conduit 1, of air, fiber tufts, trash, and dust. Debris containing fiber tufts pneumatically conveyed through the conduit 1 are, by centrifugal force, thrown outwardly against the bars or slats 21 in the area of deflection 11. The fiber tufts and a portion of the conveying air stream move past the debris trapping zone there defined and continue their movement through the conduit 1. Impact of fiber tufts on the separating element bars or slats 21 extracts from the fiber tufts debris such as stalks, husk residues, portions of leaves, metallic particles or the like. Such debris, together with a portion of the conveying air stream, enters through the openings 22 into the debris separation chamber 3. As the portion of the air stream moves through the chamber 3 in the direction of the outlet 31, the particles of debris drop by gravity into the lowermost or collecting area of the debris separation chamber 3. Such separated debris may be removed through a pneumatic line 6. The deflecting element 4 assists in separating the direction of flow of debris particles and that of the air current moving toward the outlet 31. The air current, separated from debris particles, flows through the outlet 31 and exit duct 5 to be returned at the entry point 51 to the conduit 1. Thus, the air flow induced for pneumatically conveying textile fiber tufts is maintained.

Figure 2:
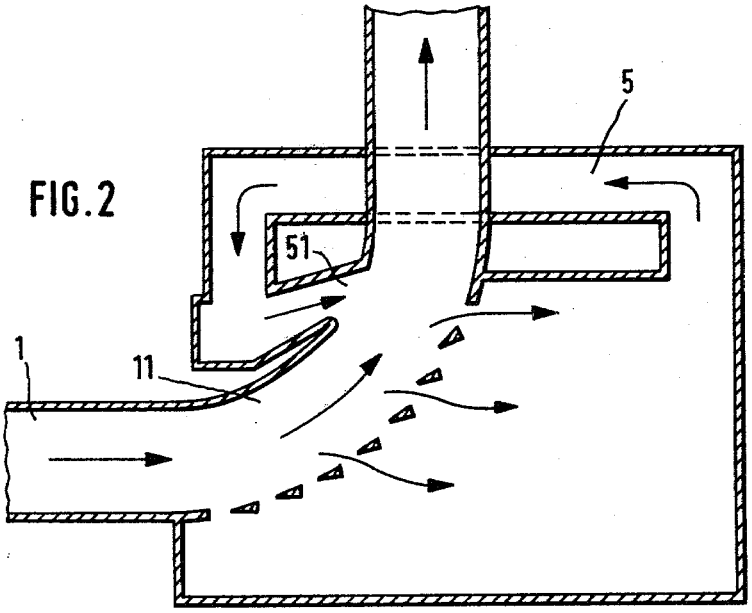
FIG. 2 is a view similar to FIG. 1, showing a second form of apparatus in accordance with this invention.

Referring now to FIG. 2, it will be noted that the conduit 1, in similarity to the arrangement of FIG. 1, has an upward turning (in the Figure) deflection area 11. However, the exit duct 5 rejoins the conduit 1 at an entry point 51 which is on the inner side of the deflection area 11, on the lesser radius of the curve. The structure and operation of the arrangement of FIG. 2 is otherwise as described above with reference to FIG. 1.

Figure 3:
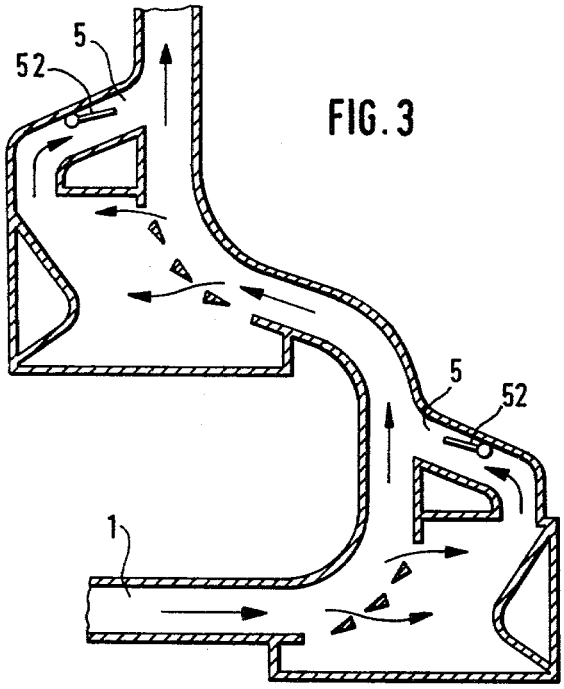
FIG. 3 is a view similar to FIGS. 1 and 2, illustrating a series flow arrangement of two devices generally similar to the device of FIG. 1.

Successive flow through two deflection areas is indicated in the arrangement of FIG. 3, illustrating two devices each generally similar to the arrangement of FIG. 1. Referring to FIG. 3, the deflection areas of the two devices involve air flows turning in first one direction and then in another. In the forms illustrated in FIG. 3, a pivoted throttle valve 52 is provided in the exit duct 5 in order to provide a means for governing the volume of air flowing through the debris trapping zone and debris separation chamber.

Figure 4:
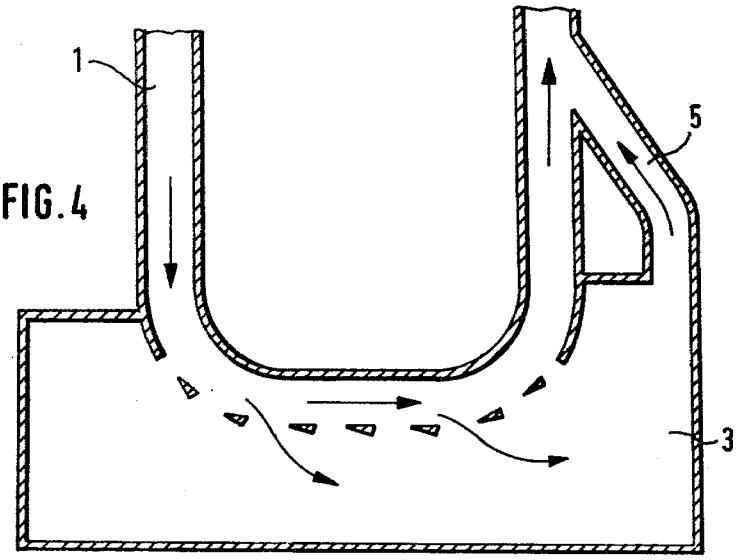
FIG. 4 is a view similar to the prior figures showing a device as arranged for a reverse flow operation.
Figure 5:
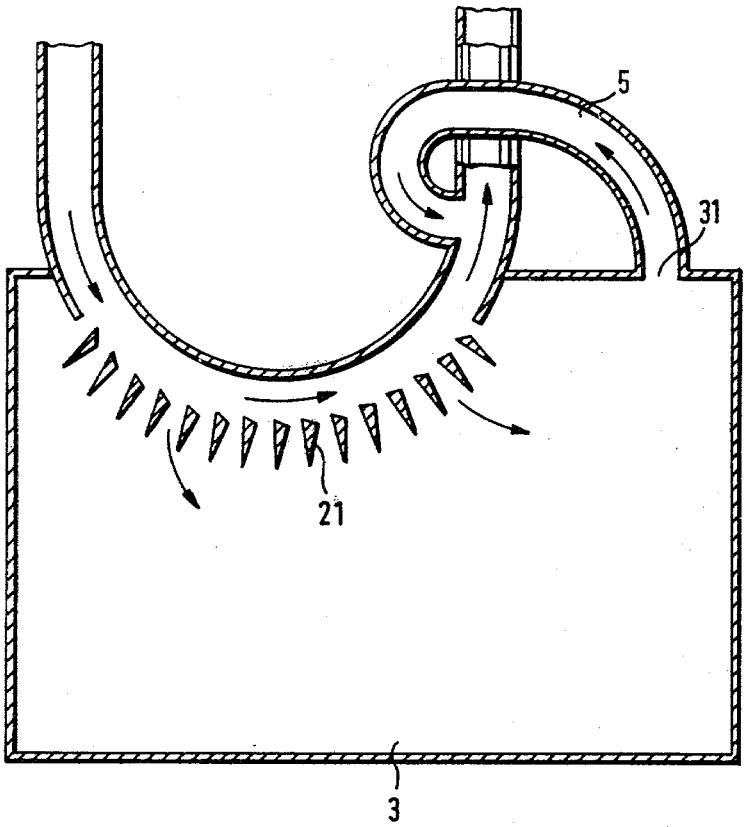
FIG. 5 is a view similar to FIG. 4 of a modified form of the device of FIG. 4.

In the arrangement of FIG. 4, two deflection areas have been brought immediately adjacent one to another, accommodating the use of a single housing means to encompass both deflection areas. The deflection areas turn through approximately 180°. Such a combined structure additionally requires only a single exit duct 5. The arrangement of FIG. 5 is similar, with the additional provision of an enlarged debris separation chamber 3 which is intended to reduce turbulence in the divided out portion of the air flow which carries debris into the separation chamber. In the arrangement of FIG. 5, the outlet 31 through which the air flow returns to the main conduit is spaced at a distance from the blades or slats 21 such that no separated debris particles are carried away through the exit duct 5. As will be appreciated by a comparison of FIG. 5 in the earlier figures in the drawings of this application, the separating slats or blades 21 may be set at varying angles, depending upon the particular characteristics of the deflection area 11 of the specific apparatus.

In the drawings and specification, there has been set forth a preferred embodiment of the invention, and although specific terms are employed, they are used in a generic and descriptive sense only and not for purposes of limitation.

That which is claimed is:

1. Apparatus for separating debris from pneumatically conveyed textile fiber tufts moving through a conduit and comprising housing means cooperating with said conduit for defining a debris separation chamber, means cooperating with said conduit for defining a curving deflection area for a stream of air flowing through said conduit and cooperating with said housing means for diverting into said separation chamber from the greater radius of said deflection area a debris laden portion of the stream of air for separating debris from the portion of the stream of air and for thus removing from said conduit debris being pneumatically conveyed with the fiber tufts, and means cooperating with said conduit for returning the diverted portion of the stream of air from said separation chamber into said conduit after separation of debris therefrom and at a location downstream and adjacent the lesser radius of said deflection area so as to restore the stream of air flowing through said conduit to substantially the original volume.

2. Apparatus according to claim 1 wherein said housing means encloses a volume capable of collecting debris separated from the diverted portion of the stream of air.

3. Apparatus according to one of claims 1 or 2 wherein said means for diverting the portion of the stream of air comprises a plurality of slats arranged in an array and defining openings therebetween through which air and debris flows from said conduit.

4. Apparatus according to one of claims 1 or 2 wherein said means for returning the diverted portion of the stream of air comprises exit duct means communicating with said conduit downstream of the location of diversion of the portion of the stream of air.

5. Apparatus according to claim 4 wherein said exit duct means rejoins said conduit as an injector nozzle for aiding an induction of air flow through said debris separation chamber.

6. Apparatus according to claim 4, further comprising throttle means mounted in said exit duct means for governing the volume of air flowing therethrough.

7. Apparatus according to claim 1 wherein said conduit and said means cooperating with said conduit for defining a deflection area define a curving deflection area turning through approximately 90°.

8. Apparatus according to claim 1 wherein said conduit and said means cooperating with said conduit for defining a deflection area define a curving deflection area turning through approximately 180°.

9. A method of separating debris from pneumatically conveyed textile fiber tufts moving through a conduit and comprising:

directing a flowing stream of air and textile fiber tufts conveyed thereby through the conduit and through a curving deflection area of the conduit while, removing from the conduit debris being pneumatically conveyed with the textile fiber tufts by diverting from the conduit and from the greater radius of the deflection area a portion of the flowing stream of air, and while separating such removed debris from the diverted portion of the flowing stream of air and returning the diverted portion of the flowing stream of air to the conduit at a location downstream and adjacent the lesser radius of the deflection area so as to restore the stream of air flowing through the conduit to substantially the original volume.

10. A method according to claim 9 wherein the returning of the diverted portion of the flowing stream of air comprises injecting the diverted portion into the conduit for aiding in diversion of the portion of the flowing stream of air.

11. A method according to claim 9 wherein the returning of the diverted portion of the flowing stream of air comprises governing the volume of the diverted portion.

12. A method for separating foreign bodies, for example, heavy particles, such as metal, wood or cardboard fragments or the like, and impurities, such as stalks, husk residues, leaf parts or the like, from cotton fiber tufts, which are pneumatically conveyed by an air current and in which the flowing direction of the air stream is curvingly deflected, comprising diverting the conveying air stream containing fiber tufts and foreign bodies into at least two partial air streams before the deflection; at least one air stream being diverted from the greater radius of the deflection; removing the foreign bodies from the at least one of the partial air streams; and reuniting the partial air streams into one conveying air stream at the lesser radius of the deflection.

13. An apparatus for separating foreign bodies including heavy particles, such as metal, wood or cardboard fragments or the like, and impurities, such as stalks, husk residues, leaf parts or the like, from cotton fiber tufts, in which cotton fiber tufts can be pneumatically conveyed by an air stream through a conduit with a curving deflection, comprising separating zone means in the area of the deflection of the conduit and having at least two chambers in aerodynamic connection with each other for dividing the conveying air stream flowing through the chambers as partial air streams, said separating zone means cooperating with the conduit for diverting a partial airstream from the greater radius of the deflection, separating foreign bodies from the diverted partial airstream and returning the diverted partial airstream at a location downstream and adjacent the lesser radius of the deflection.

* * * * *

UNITED STATES PATENT AND TRADEMARK OFFICE

CERTIFICATE OF CORRECTION

PATENT NO. : 4,344,843

DATED : August 17, 1982

INVENTOR(S) : Ferdinand Leifeld

It is certified that error appears in the above-identified patent and that said Letters Patent are hereby corrected as shown below:

In the assignee identification, first page, "Trutzscher" should be --Trutzschler--.

Col. 2, line 1, "Division" should be --Diversion--.

Col. 2, line 7, "that" should be --the--.

Col. 2, line 67, "includes" should be --include--.

Signed and Sealed this

*Eleventh* Day of *January 1983*

[SEAL]

*Attest:*

GERALD J. MOSSINGHOFF

*Attesting Officer*

*Commissioner of Patents and Trademarks*